United States Patent [19]

Perazzo

[11] 4,241,469

[45] Dec. 30, 1980

[54] SHEET OF POLISHING FIBERS COMPRISING FIBROUS LAYERS BONDED WITH PARTICLES OF THERMOPLASTIC MATERIAL

[76] Inventor: Luis R. C. Perazzo, Entre Rios 412, 2154 Capitan Bermudez, Argentina

[21] Appl. No.: 950,157

[22] Filed: Oct. 10, 1978

Related U.S. Application Data

[63] Continuation-in-part of Ser. No. 570,567, Apr. 23, 1975, abandoned.

[51] Int. Cl.[2] ..... A47L 13/04; A47L 13/16; B32B 7/14; B32B 31/20

[52] U.S. Cl. ..... 15/209 C; 156/290 C; 156/306.6; 428/96; 428/198; 428/201; 428/283; 428/285

[58] Field of Search ..... 15/209 C, 226; 428/323, 428/285, 283, 96, 198, 201; 156/290, 309

[56] References Cited

U.S. PATENT DOCUMENTS

| | | | |
|---|---|---|---|
| 2,308,405 | 1/1943 | Tully | 15/209 C |
| 2,493,968 | 1/1950 | Hepner | 15/209 C |
| 2,889,568 | 6/1959 | Winch | 15/209 C |
| 3,014,233 | 12/1961 | Gibbons | 15/209 C |
| 3,103,031 | 9/1963 | Winston | 15/209 C |
| 3,149,013 | 9/1964 | Browning et al. | 15/209 C |
| 3,171,151 | 3/1965 | Sickle et al. | 15/209 C |
| 3,185,604 | 5/1965 | Cameron | 15/209 C |
| 3,280,517 | 10/1966 | Copeland | 15/209 C |
| 3,284,963 | 11/1966 | Lanham et al. | 15/209 C |
| 3,350,735 | 11/1967 | Pratt | 15/209 C |

FOREIGN PATENT DOCUMENTS

| | | | |
|---|---|---|---|
| 899017 | 6/1962 | United Kingdom | 15/209 C |
| 946634 | 1/1964 | United Kingdom | 15/209 C |
| 948614 | 2/1964 | United Kingdom | 15/209 C |

*Primary Examiner*—James C. Cannon

[57] ABSTRACT

A sheet of polishing fibers with a double polishing face used for the purpose of cleaning or polishing all kinds of metal objects, wood or other materials. It can be used with water, soap and water and also dry without becoming clogged because it allows dirt and dust to pass through it when in use. The sheet of polishing fibers is composed of two layers of polishing fibers adhered in a very particular way by means of particles of thermoplastic material.

2 Claims, 5 Drawing Figures

SHEET OF POLISHING FIBERS COMPRISING FIBROUS LAYERS BONDED WITH PARTICLES OF THERMOPLASTIC MATERIAL

This application is a continuation-in-part of U.S. patent application Ser. No. 570,567 filed Apr. 23, 1975, and now abandoned.

BACKGROUND OF THE INVENTION

Polishing fibers, not made plastic, used for cleaning or polishing all kinds of objects, today are employed directly in form of wool or in small balls specially made, such as the so called steel wool balls. This form of use requires a voluminous mass of fibers in order to obtain a useful polishing surface that is relatively small in comparison with the quantity of fibers used.

The polishing sheet, object of this invention, makes it possible to obtain the maximum the useful polishing surface in comparison with the quantity of fibers used.

SUMMARY OF THE INVENTION

Accordingly, the polishing sheet is formed of two layers of polishing fibers. The layers are only adhered at the points which they touch each other. The group of particles of thermo-plastic material which adhere the layers of polishing fibers form a net that obliges the fibers to stay place, but it is clarified that it is a net and not a supporting lamina of thermo-plastic conglutinate.

The polishing sheet does not have a supporting lamina of thermo-plastic conglutinate in order to keep the fibers in place.

The dirt and dust can pass through when cleaning or polishing with it, avoiding, in this way, the clogging of its polishing surface.

The polishing sheet formed of two layers of fibers, adhered in the manner already specified, takes the shape of a thin and resistent sheet that, when observed through light, has the appearance of an opened mesh made of entwined fibers.

In order to make the polishing sheet it was necessary to create such a specific method that it can be considered as an integral part of this invention. For this reason the principle of this method is featured in the claims. The principle consists of hot pressing by means of a thermo-press at convenient temperature two layers of polishing fibers with a film of thermoplastic material placed therebetween.

BRIEF DESCRIPTION OF THE DRAWING

In the drawing.

It is clear that in each drawing, the same parts are indicated by the same numbers or letters, and the elements that are illustrated in order to better depict the invention are indicated by dotted lines. The brackets indicate thickness.

DESCRIPTION OF THE PREFERRED EMBODIMENT

Figure 1:
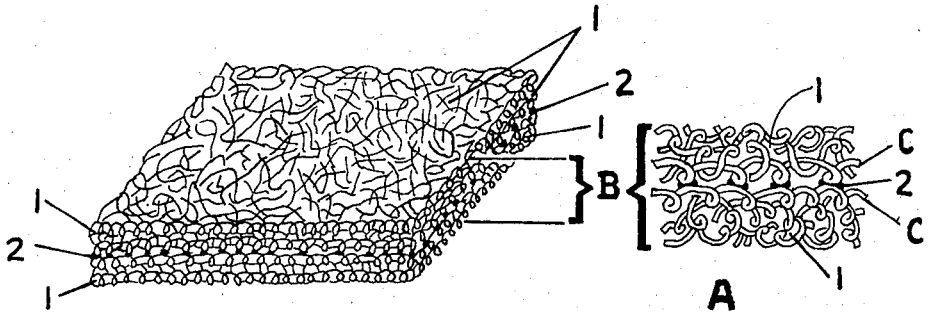
FIG. 1, is a diagram of a cut in a piece of a polishing sheet composed of two layers of polishing fibers.

In FIG. 1 is shown a polishing sheet with a double polishing face, made of two layers of polishing fibers 1, adhered by means of particles of thermo-plastic material 2. The detail A clearly shows that the layers 1 are only adhered at the point which they touch and particles of thermo-plastic material 2 coincide. The sheet of polishing fibers shown in this figure can be made approximately of 0.030 inch of thickness B, with fibers C of 0.0015 inch diameter.

Figure 2:
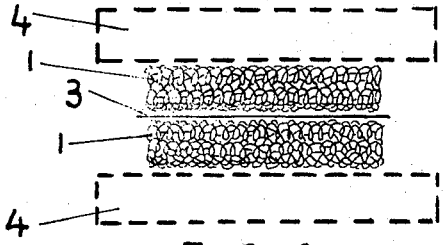
FIGS. 2, 3, 4 and 5, diagrams of the fabrication of a polishing sheet illustrated in FIG. 1.

FIG. 2 shows the correct placement of the elements, in order to fabricate a polishing sheet with two layers of polishing fibers 1, placed in between thermal plates 4, of the press, ready to initiate the thermal pressing process with the film of thermoplastic, 3, placed between the sheets of polishing fibers.

Figure 3:
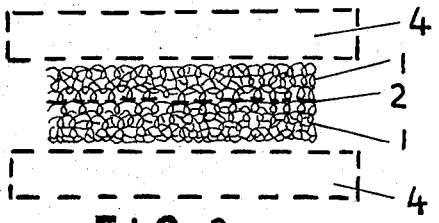

FIG. 3 shows the thermo-pressing process at the moment which the film of thermo-plastic material 3 has been converted into particles 2, due to the pressure and temperature to which it has been submitted.

Figure 4:
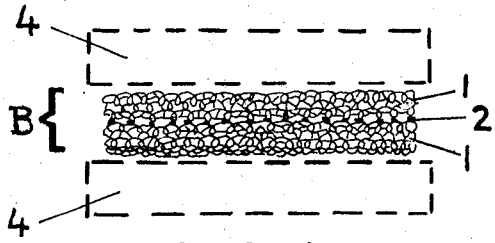

FIG. 4 shows the end of the thermo-plastic process.

Figure 5:
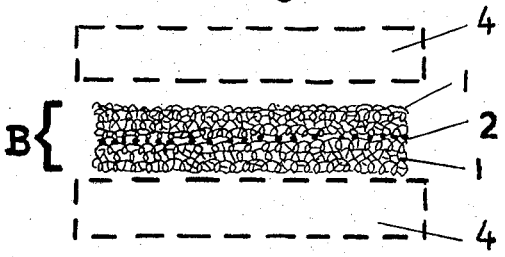

FIG. 5 shows the finished polishing sheet on one thermal plate of opened press.

In order to make a polishing sheet composed of two layers 1, a film of thermo-plastic material 3 (for example polyethylene) is placed between the two layers of polishing fibers 1, such as steel wool fibers. This is all pressed one or more times at an adequate pressure and temperature during the necessary time.

It is convenient to keep the polishing sheet, just formed, pressed until it is cooled. For this reason it is advisable to use for this work a press with thermal plates 4, that can be heated and cooled automatically.

Layers of fibers glass may be used also for the manufacture of a sheet of polishing fibers.

The manufacture of the sheet of polishing fibers formed by two layers of fibers, has been made possible by the discovery that when thermopressing the two thin polishing layers of fibers with a thermoplastic film of a suitable thickness placed between the two layers of fibers seen in drawing 2, the film melts and changes into particles 2 (drawings 1, 3, 4 and 5) which join the fiber C of the upper fibrous layer with the fiber C of the lower fibrous layer, that is to say that the particles 2 remain located only at the points where fibers contact.

It can be seen in detail A in the drawing 1 in this application that the particles 2 do not bind the fibers while in the drawing 3 of Winston's U.S. Pat. No. 3,103,031 the globules 13 (adhesive particles) binding the fibers are seen.

The particles 2 do not bind the fibers C (upper and lower) as occurs with the globules 13 in Winston's drawing 3, wherein an article produced through use of an adhesive spray is shown. Neither the sheet of polishing fibers formed by two fibrous layers which the instant disclosure describes nor any sheet of an equivalent thickness of approximately 0.045 inches can be manufactured with adhesive spray because the fibers would lose their abrasive power and the sheet would have no strength for its use. It should be noted that the normal thickness of Winston's fibrous mass is about ½ inch.

To make the invention clearer an example is given of the manufacture of a sheet of polishing fibers formed by two layers of polishing fibers as presented in drawing 1 and in detail A. Two layers of woolen steel fibers of 0.0015 inch diameter and a polyethylene film of 0.0013 inch of thickness were used. The film was placed between two layers of woolen steel approximately 0.02 inches thick formed by loose fibers laid longitudinally and available commercially in roll form. The layers were pressed between the heated press plates at a temperature of 170° C. and an approximate pressure of 7 kilos per $cm^2$. Once the two thermic plates were cold, the sheet of polishing fibers was taken out, the thermic plates were cleaned from the polyethylene particles which remained adhered to the same, the sheet of polishing fibers was placed again between them and a second thermopressing was done in the same way as before.

Once the thermic plates were cold the sheet of polishing fibers manufactured was taken out, which had a thickness between 0.030 and 0.045 inch.

While the present invention has been described with particular reference to specific example, it is not to be limited thereby, but reference is to be had to the appended claims for a definition of its scope.

To obtain the evidence that the particles of polyethylene did not bind the fibers of the woollen steel, a piece of a sheet of polishing fibers manufactured in the specified condition was placed in a hydrochloric acid solution which dissolved the fibers of woollen steel leaving an extremely thin bidimensional net of polyethylene particles which did not show any particles of woollen steel in its interior, which proves that the particles of thermoplastic material do not bind the fibers.

In the detail A of the drawing 1, one can clearly see that the sheet of polishing fibers is made up of fibers such as the upper and lower fibers C that are adhered by means of the adhesive particles 2 as well as by a limited percentage of mingled fibers. The fibers other than this percentage stay loose. This is the reason why the sheet of polishing fibers made up of two fibrous layers of my invention, has to be necessarily very thin. To simplify the drawing in the detail A, the fiber C of the upper layer has been represented as adhered by means of the particles 2 to the same fiber C of the lower layer, but although it is obvious, it is necessary to clarify that the adhesive points (particles 2), between fibers of the upper layer 1 and fibers of the lower layer 1 are distributed at random. In practice it is most probable that a fiber from the upper layer 1 is adhered by adhesive particles 2 in the same way as shown before, to a huge number of fibers of the lower layer 1, or viceversa, specially when dealing with very long fibers.

The distribution of the adhesive particles 2 between the upper and lower layers 1 forms a bidimensional net of adhesive particles 2; this is another fundamental difference of my article to that of Winston's (U.S. Pat. No. 3,130,031) which shows a threedimensional net.

The invention of the sheet of polishing fibers is important to the woolen steel industry wherein a useful conversion of bulky woolen steel into thin steel fiber sheets has long been of interest. The thin, strong and flexible sheets of polishing fibers made up of two layers of wool steel polishing fibers in the specified way allow the concentration of the abrasive capacity of big bulks of woolen steel fibers in small packets of woolen steel fibers that offer the maximum utility of the abrasive capacity of the fibers.

The storage and transportation advantages are obvious. Moreover, the buyer may use the sheets of polishing fibers in a direct way or by wrapping them about an element such as, for example, a sponge. Due to the small quantity of abrasive material (woolen steel) used in the sheet of polishing fibers in proportion to the large polishing surface in use the sheets turn out to be extremely economical and thus lend themselves to being used as disposables. The orientation and size of the fibers that form the layers of woolen steel may be most varied. The sheet of polishing fibers may be manufactured as a continuous length. In this case instead of using heated plates, heated steel rolls would be used for its manufacture.

I claim:

1. A sheet of polishing fibers which consist of two superposed thin layers of polishing fibers with opposed interior surfaces of the layers adhered to one another by means of particles of thermoplastic material which bond fibers from the interior surface of one layer to fibers from the interior surface of the other layer only at points of fiber contact, the particles of thermoplastic material functioning to keep the fibers in their proper place by forming a bidimensional net with the bonded fibers.

2. A method of manufacturing the sheet of polishing fibers of claim 1 which comprises interposing a film layer of thermoplastic material, of such thickness that it forms the thermoplastic particles of the sheet of claim 1 under heating conditions between the superposed thin layers of polishing fibers and thereafter subjecting the superposed layers to heat and pressure.

* * * * *